US005314183A

United States Patent [19]

Schoen

[11] Patent Number: 5,314,183

[45] Date of Patent: May 24, 1994

[54] SET OF TILES FOR COVERING A SURFACE

[76] Inventor: Alan H. Schoen, 316 W. Oak St., Carbondale, Ill. 62901

[21] Appl. No.: 32,311

[22] Filed: Mar. 17, 1993

[51] Int. Cl.[5] ..... A63F 9/10; A63F 1/00

[52] U.S. Cl. ..... 273/157 R; 273/294

[58] Field of Search ..... 273/157 R, 156

[56] References Cited

U.S. PATENT DOCUMENTS 3,637,217 1/1972 Kent ..... 273/157 R
4,223,890 9/1980 Schoen ..... 273/157 R
4,561,097 12/1985 Siegel ..... 273/157 R
4,773,649 9/1988 Cheng ..... 273/157 R

*Primary Examiner*—Benjamin H. Layno
*Attorney, Agent, or Firm*—Nields & Lemack

[57] ABSTRACT

A set of tiles each of which is distinct from the other tiles in the set is arranged in a particular circle tiling having various unusual properties. As a result of these properties, each one of a number of sub-sets of these tiles may be identified by a characteristic color or other characterizing mark, and these sub-sets, so identified, may be used in various ways as a recreational puzzle, as a game, as an educational tool, for aesthetic purposes, and for a variety of other uses.

15 Claims, 8 Drawing Sheets

SET OF TILES FOR COVERING A SURFACE

BACKGROUND OF THE INVENTION

1. Field of the Invention

This invention relates to the field of geometry known as tessellation, which has been defined as the covering of prescribed areas with tiles of prescribed shapes. Practical applications of this field include the design of paving and wall-coverings, the production of toys and games, and educational tools.

2. Description of the Prior Art

This invention makes use of the set of tiles disclosed and claimed in U.S. Pat. No. 4,223,890 to Schoen.

SUMMARY OF THE INVENTION

The present invention comprehends Various sub-sets of the set of tiles disclosed and claimed in U.S. Pat. No. 4,223,890 (hereinafter referred to as a "rombix set") which have various unusual properties to be described hereinafter. A rombix set is herein defined as a set of tiles which is capable of covering a plane surface bounded by a regular polygon of 2n sides, said regular polygon being dissectible into a set of $(n-1)n/2$ rhombuses, comprising one specimen of each distinct rhombus in said set and one specimen of each distinct shape formed by combining two of the remaining rhombuses in said set in such a manner that no two edges at any vertex are collinear. It should be noted that the term "rombix set" refers to the aforementioned set of tiles, only some of which are actual rhombuses, whereas the term "set of rhombuses used to form a rombix set" or "standard rhombic inventory" refers to the set of $(n-1)n/2$ rhombuses into which the regular polygon is dissectible.

Each said specimen formed by thus combining two rhombuses may be designated a "twin" and has an outer notch in its periphery and is identifiable by two integers i and j which are the indices of the convex interior face angles flanking said notch, wherein i is not less than j. Each said specimen which is an actual rhombus may be designated a "keystone". In the instant specification and claims the term "specimen" is thus often used interchangeably with the term "tile" in referring to the elements of a rombix set.

The present invention also comprehends a particular circle tiling of a rombix set which may be designated a "cracked egg tiling". In the cracked egg tiling, tiles cover the plane surface bounded by a regular polygon of 2n sides (which approximates a circle) in the following configuration of vertical columns of specimens, wherein all said notches in the longest vertical column face in the same direction and all said notches in the other vertical columns face said longest vertical column, and the integers within each bracket identify the particular specimen as well as its orientation:

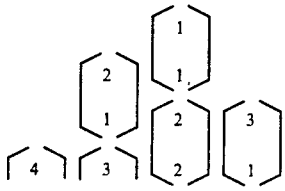

etc., said configuration setting forth a series of rows of integers as shown in which each succeeding row reverses the order of the integers in the next preceding row and adds the next higher integer after the highest integer of said preceding row until the last row, in which the highest integer is $n-1$ and in which completion of the row is achieved by brackets having a single integer rather than a pair of integers so as to designate the specimens each of which is a rhombus, the index of any angle of A degrees being defined as equal to An/180, or in the mirror image of said configuration.

The invention also comprehends identifying various vertical columns or horizontal rows of specimens in the cracked egg configuration by a characteristic color or other characterizing mark in such a manner that the aforementioned sub-sets may be identified by said characterizing mark. Because of the use of color for identification, these sub-sets may be designated "monochrome sub-sets".

Once the sub-sets, identified by color or other characterizing mark, have been thus obtained, they may be used to carry out at least the following four activities:

1. Circle tilings with color constraints;
2. The tiling of matched islands;
3. The tiling of matched ladders (even n) and matched pseudo-ladders (odd n);
4. The tiling of conjugate ovals.

DETAILED DESCRIPTION OF THE INVENTION

Figure 1:
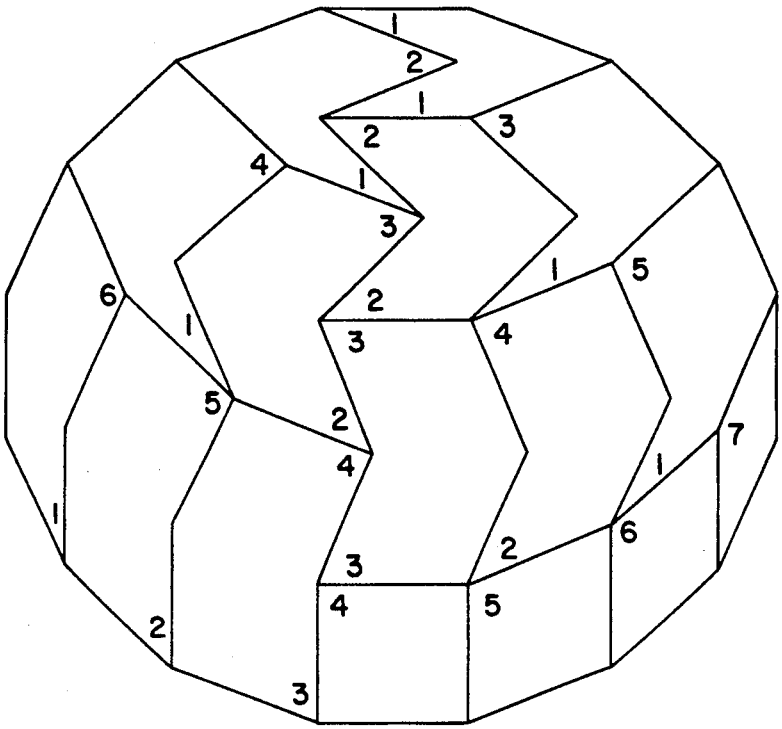
FIG. 1 is a plan view of an assembly of tiles arranged into a regular polygon in accordance with the invention disclosed and claimed in said U.S. Pat. No. 4,223,890, wherein the pattern is that of the cracked egg circle tiling for $n=8$.

Referring to the drawings, and first to FIG. 1 thereof, therein is shown the cracked egg circle tiling for n=8. The regular polygon therein shown has 16 (2n) sides, and is dissectible into a set of (8−1)8/2=28 rhombuses. Each rhombus has one of four distinct shapes, each of which may be identified by any one of its four convex interior face angles. Rather than identifying such angles by their magnitude in degrees or radians, it is more convenient to identify each angle by an index. Each index is an integer, and the set of indices runs from 1 for the smallest angle to (n−1) for the largest angle. Thus, for n=8, the indices run from 1 to 7. In general, the index of any angle of A degrees may be defined as equal to An/180. However, these indices represent only four distinct shapes of rhombus, since each rhombus having an index 1 also has an index 7, each rhombus having an index 2 also has an index 6, each rhombus having an index 3 also has an index 5, and the rhombus having an index 4 is the square. As may be seen from FIG. 1, the set of tiles includes one specimen of each distinct rhombus in said set, and these specimens are identified by a single index (4, 5, 6 and 7 in FIG. 1). Each such specimen may be designated a "keystone". The remaining specimens each comprise a distinct shape formed by combining two of the remaining rhombuses in said set in such a manner that no two edges at any vertex are collinear. Each such specimen may be designated a "twin", has an outer notch in its periphery, and is identifiable by two integers i and j which are the indices of the convex interior face angles flanking said notch, wherein i is not less than j. Three of the specimens are "identical twins", identified by the pairs of integers 1,1; 2,2; and 3,3. Among the remaining specimens, it will be noticed that two rhombuses of certain distinct shapes, respectively, may be combined in two different ways; thus a rhombus having an index 1 (and 7) may be combined with a rhombus having an index 2 (and 6) so as to form not only the specimen 2 1 but also the specimen 6,1, and the shape of the specimen 2,1 differs from that of the specimen 6,1. The square rhombus may be combined with any non-square rhombus in only one way. The configuration shown in FIG. 1 may be identified by the various indices in the following manner.

It will be seen that a vertical zig-zag line runs down the approximate center of the polygon, and that all notches face this zig-zag line, which may be referred to as "the Great Divide". The specimens are arranged in columns on either side of the Great Divide. The longest column is adjacent the Great Divide and comprises the identical twins and the square. The configuration may be identified by the following numerical representation, wherein the integers within each bracket identify the particular specimen as well as its orientation:

$$
\begin{array}{ccccccc}
 & & & \begin{bmatrix}1\\1\end{bmatrix} & & & \\
 & & \begin{bmatrix}2\\1\end{bmatrix} & \begin{bmatrix}2\\2\end{bmatrix} & \begin{bmatrix}3\\1\end{bmatrix} & & \\
 & \begin{bmatrix}4\\1\end{bmatrix} & \begin{bmatrix}3\\2\end{bmatrix} & \begin{bmatrix}3\\3\end{bmatrix} & \begin{bmatrix}4\\2\end{bmatrix} & \begin{bmatrix}5\\1\end{bmatrix} & \\
\begin{bmatrix}6\\1\end{bmatrix} & \begin{bmatrix}5\\2\end{bmatrix} & \begin{bmatrix}4\\3\end{bmatrix} & \begin{bmatrix}4\end{bmatrix} & \begin{bmatrix}5\end{bmatrix} & \begin{bmatrix}6\end{bmatrix} & \begin{bmatrix}7\end{bmatrix}
\end{array}
$$

The foregoing configuration sets forth a series of rows of integers as shown in which each succeeding row reverses the order of the integers in the next preceding row and adds the next higher integer after the highest integer of said preceding row until the last row, in which the highest integer is n−1 and in which completion of the row is achieved by brackets having a single integer rather than a pair of integers so as to designate the specimens each of which is a rhombus.

In general, the cracked egg circle tiling for even n will have an appearance generally similar to that of FIG. 1.

Figure 2:
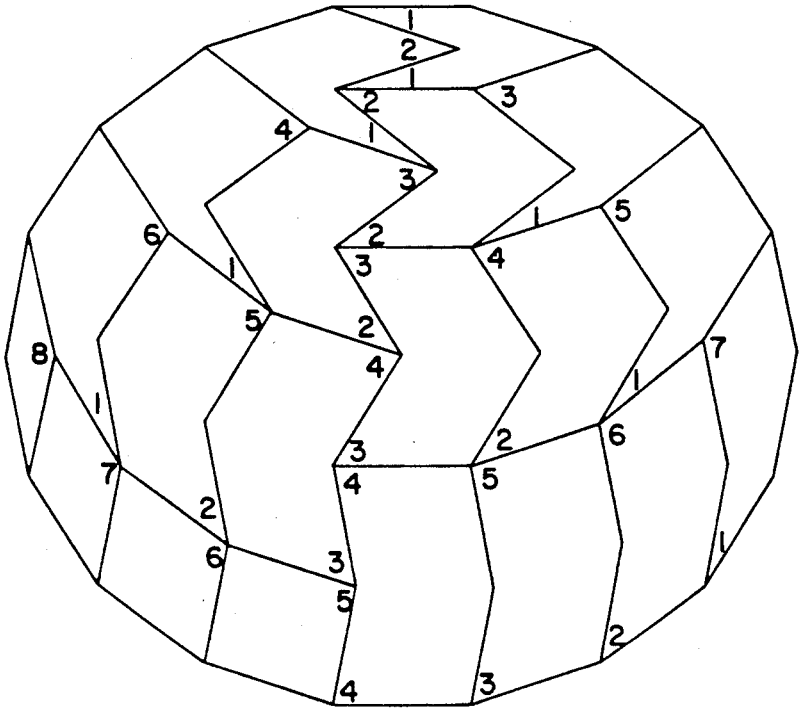
FIG. 2 is a plan view, similar to that of FIG. 1, for $n=9$.

Referring now to FIG. 2, therein is shown the cracked egg circle tiling for n=9, and it will be seen that certain complications appear in dealing with the cracked egg circle tiling for odd n. Nevertheless, certain similarities will be apparent to the case for even n. The regular polygon shown in FIG. 2 has 18 (2n) sides, and is dissectible into a set of (9−1)9/2=36 rhombuses. Each rhombus has one of four distinct shapes, each of which may be identified by any one of its four convex interior face angles. Rather than identifying such angles by their magnitude in degrees or radians, it is more convenient to identify each angle by its index as hereinbefore defined. As before, each index is an integer, and the set of indices runs from 1 for the smallest angle to (n−1) for the largest angle. Thus, for n=9, the indices run from 1 to 8. However, these indices represent only four distinct shapes of rhombus, since each rhombus having an index 1 also has an index 8, each rhombus having an index 2 also has an index 7, each rhombus having an index 3 also has an index 6, and each rhombus having an index 4 also has an index 5. For odd n, unlike for even n, there is no square. As may be seen from FIG. 2, the set of tiles includes one specimen of each distinct rhombus in said set, and these specimens are identified by a single index (5, 6, 7 and 8 in FIG. 2). Each such specimen may be designated a "keystone". The remaining specimens each comprise a distinct shape formed by combining two of the remaining rhombuses in said set in such a manner that no two edges at any vertex are collinear. Each such specimen may be designated a "twin", has an outer notch in its periphery, and is identifiable by two integers i and j which are the indices of the convex interior face angles flanking said notch, wherein i is not less than j. Four of the specimens are "identical twins", identified by the pairs of integers 1,1; 2,2; 3,3; and 4,4. Among the remaining specimens, it will be noticed that two rhombuses of certain distinct shapes, respectively, may be combined in two different ways; thus a rhombus having an index 1 (and 8) may be combined with a rhombus having an index 2 (and 7) so as to form not only the specimen 2,1 but also the specimen 7,1, and the shape of the specimen 2,1 differs from that of the specimen 7,1. The configuration shown in FIG. 2 may be identified by the various indices in the following manner.

It will be seen that a vertical zig-zag line runs down the approximate center of the polygon, and that all notches face this zig-zag line, which may be referred to as "the Great Divide". The specimens are arranged in columns on either side of the Great Divide. The longest column is adjacent the Great Divide and comprises the identical twins. The configuration may be identified by the following numerical representation, wherein the integers within each bracket identify the particular specimen as well as its orientation:

$$
\begin{array}{ccccccccc}
 & & & & & & & \begin{bmatrix}1\\1\end{bmatrix} & \\
 & & & & & & \begin{bmatrix}2\\1\end{bmatrix} & \begin{bmatrix}2\\2\end{bmatrix} & \begin{bmatrix}3\\1\end{bmatrix} \\
 & & & & & \begin{bmatrix}4\\1\end{bmatrix} & \begin{bmatrix}3\\2\end{bmatrix} & \begin{bmatrix}3\\3\end{bmatrix} & \begin{bmatrix}4\\2\end{bmatrix} & \begin{bmatrix}5\\1\end{bmatrix} \\
 & & & \begin{bmatrix}6\\1\end{bmatrix} & \begin{bmatrix}5\\2\end{bmatrix} & \begin{bmatrix}4\\3\end{bmatrix} & \begin{bmatrix}4\\4\end{bmatrix} & \begin{bmatrix}5\\3\end{bmatrix} & \begin{bmatrix}6\\2\end{bmatrix} & \begin{bmatrix}7\\1\end{bmatrix} \\
\begin{bmatrix}8\end{bmatrix} & \begin{bmatrix}7\end{bmatrix} & \begin{bmatrix}6\end{bmatrix} & \begin{bmatrix}5\end{bmatrix} & & & & & &
\end{array}
$$

The foregoing configuration sets forth a series of rows of integers as shown in which each succeeding row reverses the order of the integers in the next preceding row and adds the next higher integer after the highest integer of said preceding row until the last row, in which the highest integer is $n-1$ and in which completion of the row is achieved by brackets having a single integer rather than a pair of integers so as to designate the specimens each of which is a rhombus.

In general, the cracked egg circle tiling for odd n will have an appearance generally similar to that of FIG. 2.

An important feature of the invention will now be described. It is the derivation of certain sub-sets from the cracked egg circle tiling. These sub-sets may be derived by identifying each of them by a characteristic color or other characterizing mark, and it is convenient to refer to them as "monochrome sub-sets". The derivation of the monochrome subsets for even n is relatively straightforward, but the derivation of the monochrome subsets for odd n involves certain complications, as will appear hereinafter.

Figure 3:
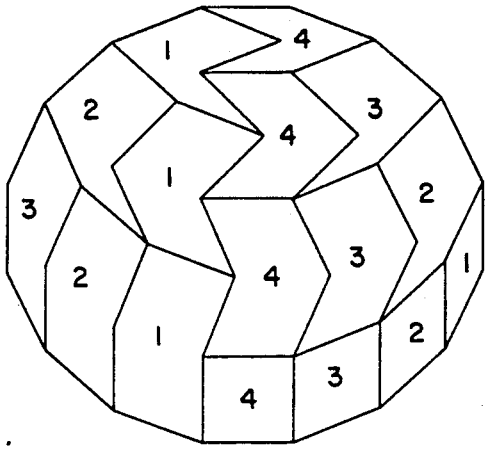
FIG. 3 is a plan view, similar to that of FIG. 1, and showing a first coloring scheme (hereinafter sometimes referred to as C.S.(I)) suitable for even n.

Referring now to FIG. 3, therein is shown a coloring scheme for $n=8$ which is easily adaptable to any cracked egg configuration for even n. Whereas in FIGS. 1 and 2 the numbers represented indices of angles, in FIG. 3 (as well as in FIGS. 4, 5 and 6) the numbers represent colors or other characterizing marks. As is apparent from the numbers in FIG. 3, each vertical column of specimens is identified by a characteristic color or other characterizing mark in such a manner that the longest vertical column has one mark and the sequence of marks of successive vertical columns to the left from said longest vertical column is the reverse of the sequence of marks of successive vertical columns to the right from said longest vertical column.

Figure 4:
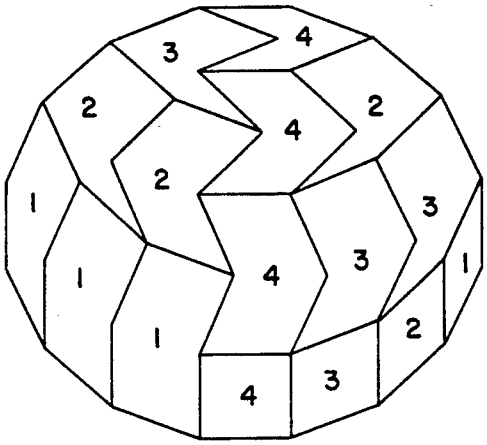
FIG. 4 is a plan view, similar to that of FIG. 1, and showing a second coloring scheme (hereinafter sometimes referred to as C.S.(I*))suitable for even n.

Referring now to FIG. 4, therein is shown a second coloring scheme for $n=8$ which is adaptable to any cracked egg configuration for even n. As in FIG. 3, the numbers represent colors or other characterizing marks. As is apparent from the numbers in FIG. 4, the longest vertical column of specimens and the horizontal rows of specimens on either side of said column are identified by a characteristic color or other characterizing mark in such a manner that the longest vertical column has one mark and the specimens the notches whereof face towards the notches of said longest vertical column form a first configuration of rows each having a characteristic color or other characterizing mark which differs from that of the longest vertical column and from that of all other rows in said first configuration of rows, the sequence of marks of successive horizontal rows from the bottom row to the top row being identifiable by a sequence of integers 1,2,3 . . . k, where k is the number of said horizontal rows, the remaining specimens forming a second configuration of rows each having a characteristic color or other characterizing mark which differs from that of the longest vertical column and from that of all other horizontal rows in said second configuration of rows except for the bottom row thereof, the sequence of marks of successive horizontal rows from the top row to the row immediately above the bottom row being identifiable by the sequence of integers 2,3, . . . k, where each integer has the aforementioned significance, and wherein the sequence of marks of successive specimens in said bottom row of said second configuration from said longest vertical column is identifiable by the sequence of integers k, $(k-1)$, . . . 1, where each integer has the aforementioned significance.

Figure 5:
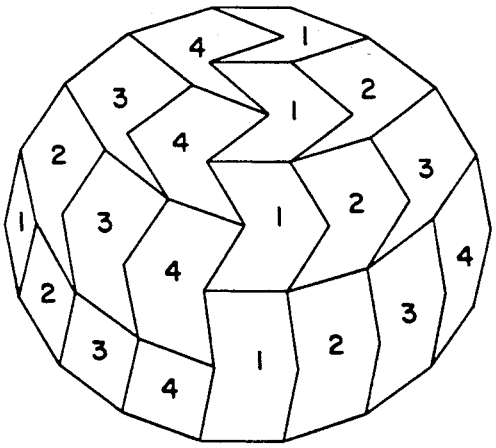
FIG. 5 is a plan view, similar to that of FIG. 2, and showing a first coloring scheme (hereinafter sometimes referred to as C.S.(I)) suitable for odd n.

Referring now to FIG. 5, therein is shown a coloring scheme for $n=9$ which is adaptable to all cracked egg configurations for odd n. As in FIGS. 3 and 4, the numbers represent colors or other characterizing marks. As is apparent from the numbers in FIG. 5, each vertical column of specimens is identified by a characteristic color or other characterizing mark in such a manner that the sequence of marks of successive vertical columns from the left to the left-hand vertical column of the pair of longest vertical columns is the reverse of the sequence of marks of successive vertical columns from the right to the right-hand vertical column of said pair of longest vertical columns. For purposes of the foregoing, the length of a vertical column may be measured in terms of the number of specimens contained therein.

Figure 6:
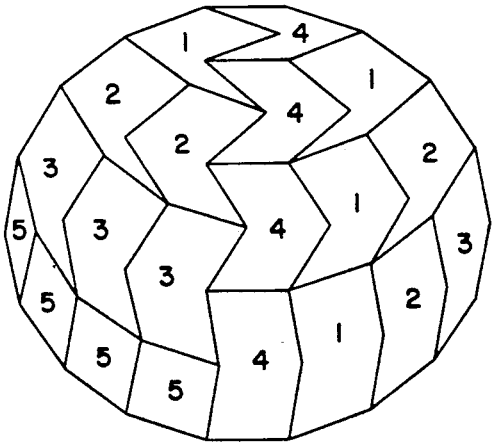
FIG. 6 is a plan view, similar to that of FIG. 2, and showing a second coloring scheme (hereinafter sometimes referred to as C.S.(II)) suitable for odd n.
Figure 10:
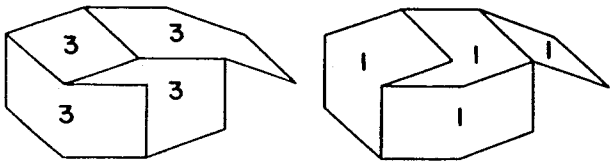
FIGS. 7 through 12 are plan views showing the arrangement of the monochrome subsets of FIG. 3 in tilings of matched islands for $n=8$.
Figure 11:
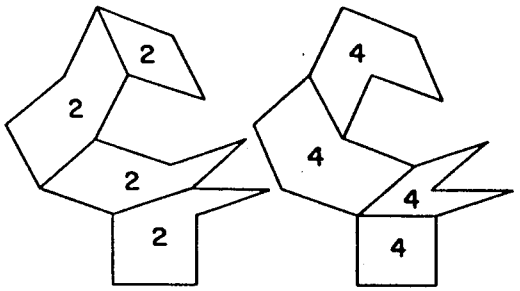
Figure 12:
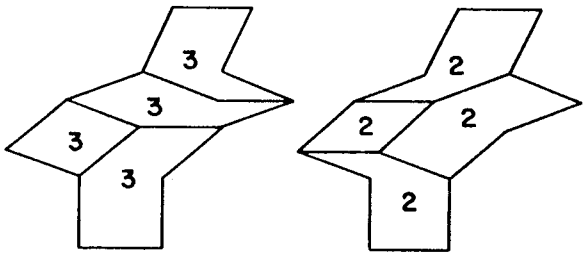
Figure 7:
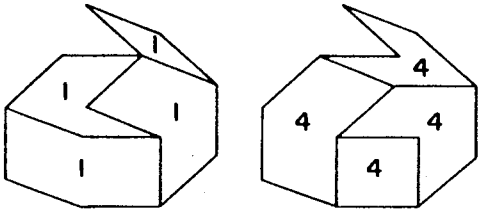
Figure 8:
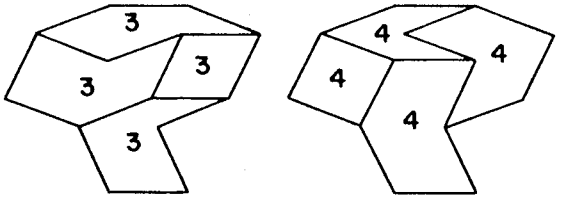
Figure 9:
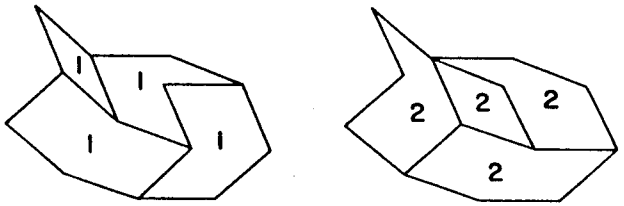
Figure 13:
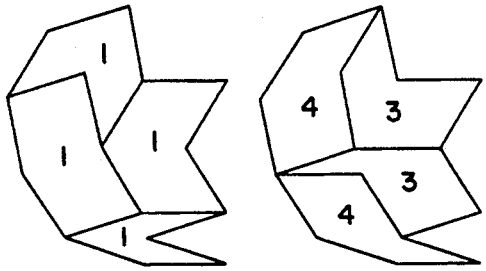
FIGS. 13 through 16 are plan views showing the arrangement of the monochrome subsets of FIG. 6 in tilings of matched islands for $n=9$.
Figure 14:
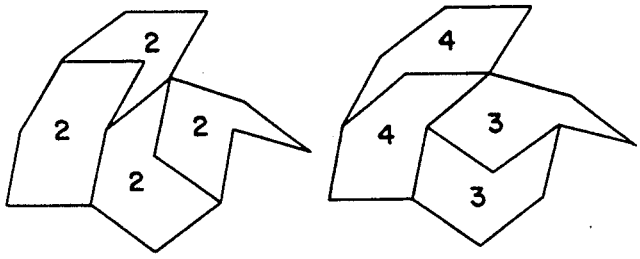
Figure 15:
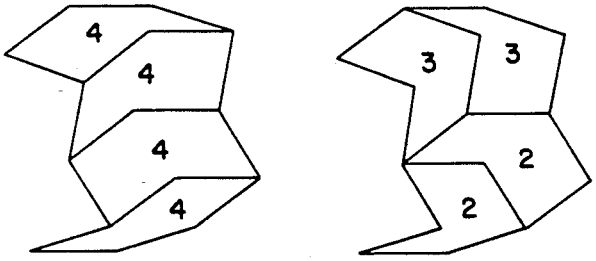
Figure 16:
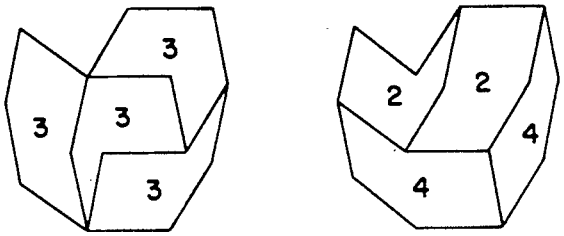
Figure 17:
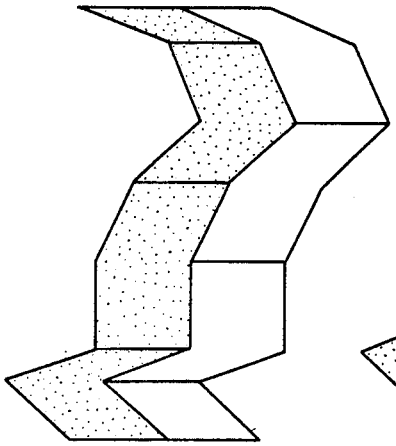
FIGS. 17 through 22 are plan views showing the arrangement of the monochrome sub-sets of FIG. 3 in tilings of matched ladders.
Figure 18:
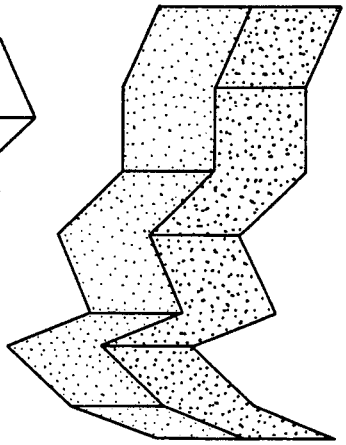
Figure 19:
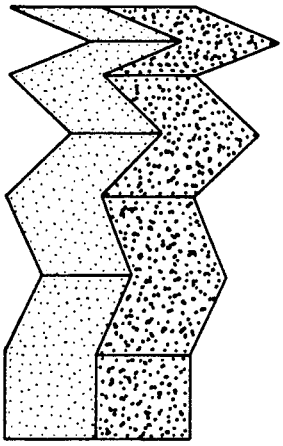
Figure 20:
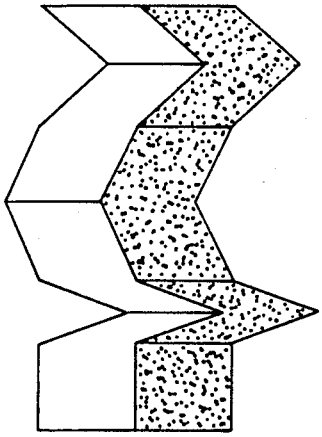
Figure 21:
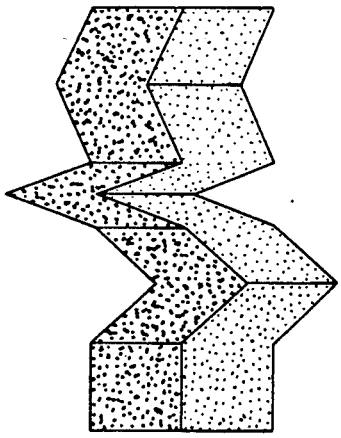
Figure 22:
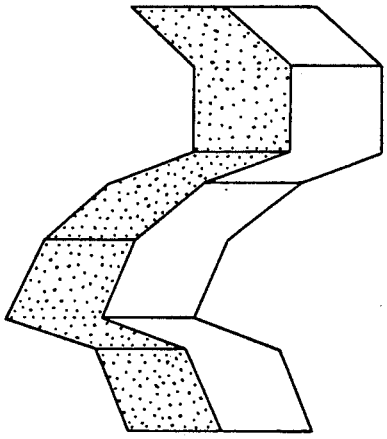
Figure 23:
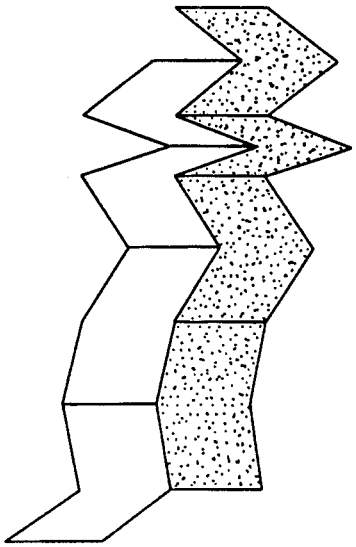
FIGS. 23 through 27 are plan views, similar to those of FIGS. 17 through 22, showing the arrangement Of the monochrome sub-sets of FIG. 6 in tilings of matched pseudo-ladders.
Figure 24:
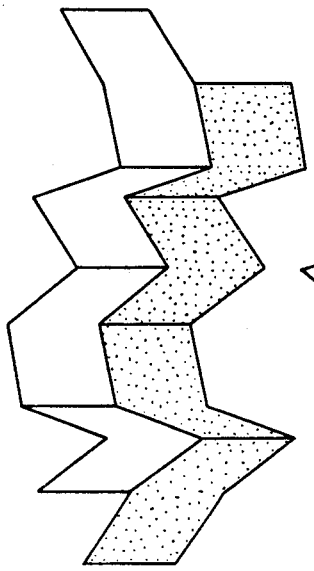
Figure 25:
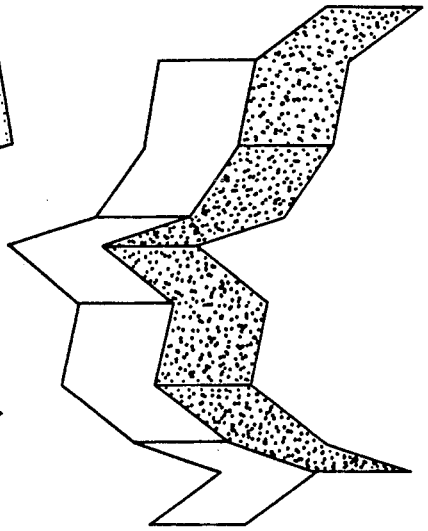
Figure 26:
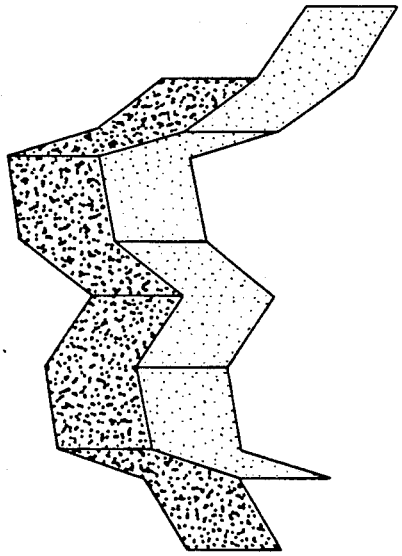
Figure 27:
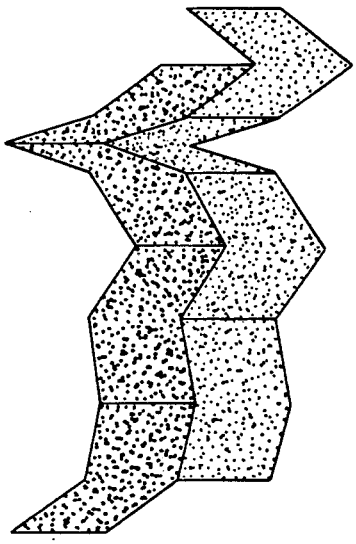

Referring now to FIG. 6, therein is shown a coloring scheme for $n=9$ which is adaptable to all cracked egg configurations for odd n. As in FIGS. 4 and 5, the numbers represent colors or other characterizing marks. As is apparent from the numbers in FIG. 6, each vertical column of specimens at that side of the longest vertical column which is remote from the notches in the specimens comprising said longest vertical column is identified by a characteristic color or other characterizing mark in such a manner that the sequence of marks of successive vertical columns from (but not including) said longest vertical column to said one side is the same as the sequence of marks of successive horizontal rows of specimens at the other side of said longest vertical column from the top to (but not including) the bottom row, said longest vertical column and said bottom row each being identified by a separate mark. For purposes of the foregoing, the length of the vertical column in the pair of longest vertical columns which contains a keystone may be considered to be less than the length of the vertical column in the pair of longest vertical columns which does not contain a keystone.

The general scheme is as follows:

The first column to the right of the long central-column is called subset 1, and columns to its right are successively labelled 2,3, . . ., $\{(n-1)/2\}-1$.

Rows are similarly labelled from 1 to $\{(n-1)/2\}-1$ at the left of the long central column, from the top down.

The central column is labelled $(n-1)/2$, and the Keystone set is labelled $(n+1)/2$.

If one closely examines the four twins in Subset 2, it may be seen that they consist of two isomers of each of the two twins (the "isomers" ["long" and "short"] contain the same two rhombuses).

The foregoing description has shown how various monochrome subsets may be determined from a set of tiles covering a plane surface bounded by a regular polygon of 2n sides. These monochrome subsets are suitable for, and in some cases required for, carrying out the four activities hereinbefore mentioned.

Referring first to the first activity, "circle tilings with color constraints", there are in particular two such tilings of considerable puzzle value. They are of essentially opposite character:

1. Dispersed Colors: No two specimens of the same color are allowed to touch except at a point;
2. Sequestered Colors: The specimens of each monochrome subset are sequestered into a separate simply-connected region.

Referring now to the second activity, "the tiling of matched islands", an "island" is any shape distinct from a ladder or pseudo-ladder which can be tiled by a number of specimens, which number is at least two but less than the number of specimens in a rombix set. Matched Islands are the subject of the following puzzle activity, in which it is necessary that all of the monochrome subsets have the same area. This requirement is satisfied for even n either by using the coloring scheme of FIG. 3 (C.S.(I)) or the coloring scheme of FIG. 4 (C.S. (I*)) for the coloring, and for odd n by using the coloring scheme of FIG. 6 (C.S.(II)).

First, all of the specimens in one of the monochrome subsets are used to tile a certain shape, which is called an "island". Let us denote this tiling of the island shape by Tiling 1. Next this island is tiled with specimens selected from other monochrome subsets, using specimens from the smallest possible number of subsets. i.e., as few colors as possible. Let us call this second tiling of the island Tiling 2. For convenience, we will refer to Tiling 2 as monochrome if it is tiled by the specimens of a single other monochrome subset.

When n is even, there is a single Keystone included in each monochrome subset. When n is odd, for the coloring scheme of FIG. 6, there is no Keystone included in any subset except for the special Keystone subset, which (since it has only half the area of the other subsets) is not involved in any Matched Islands tiling activities. The presence of a single Keystone in each subset for even n is enough to allow a considerable amount of freedom in designing the shape of an island, as compared to the case of odd n. As a result, it is often possible, for even n, to find one or more Tiling 2 solutions which (like Tiling 1 itself) contain the specimens of only one monochrome subset.

For $n=8$, for example, for every one of the six ways of choosing a pair of subsets from the four monochrome subsets, it is possible to construct a Tiling 1 island which is matched by a monochrome Tiling 2. An example for each of these six cases is shown in FIGS. 7 through 12.

But for odd n, the absence of Keystones from the Twin monochrome subsets severely limits their "interchangeability" in the tiling of Matched Islands. Nevertheless, Matched Island is still a very satisfactory puzzle for odd For $n=9$, the situation is as follows:

For each of the four monochrome subsets, there exists an island (Tiling 1), tiled by the four specimens of the subset, which can also be tiled (Tiling 2) by four specimens selected from two other subsets: two from one subset and two from another. The combined areas of the two specimens in each of these pairs of specimens is the same: exactly half that of a monochrome subset. These tilings are shown in FIGS. 13 through 16.

Considerable ingenuity is required to find shapes for matched islands which can be tiled by more than two different monochrome subsets, especially for rombix sets for large n. Considerable ingenuity is required to find Matched Islands for $n>7$. The number of possible candidate shapes for islands, even when the monochrome subsets contain only four specimens, as is the case for $n=8$ and $n=9$, is very large, and it is necessary to test a variety of candidates before an optimum solution can be found. (It is also true that one can speed up the search somewhat by recognizing what constraints are imposed by the shapes of some of the specimens in the subset used to tile Tiling 1, but this requires considerable experience.

Referring now to the third activity, "the tiling of matched ladders (even n) and matched pseudo-ladders (odd n)," a "ladder" is a strip of specimens which are joined pairwise, edge-to-edge, with parallel "rungs" (pairs of opposite specimen edges). It is convenient to define a "ladder" in terms of the rhombuses contained in the specimens, and as so defined a ladder contains two examples of each shape of rhombus in the standard rhombic inventory except for the square rhombus. Each rhombus in the ladder, except for the square, occurs once in each of its two possible orientations. For odd n, the square rhombus is absent from the standard rhombic inventory, and therefore also from every ladder. For even n, the square is included in the standard rhombic inventory, and therefore it appears (once) in every ladder.

The equal area property of monochrome subsets for even n makes the following puzzle activity possible for even n:

1. Select any two monochrome subsets; call them A and B.
2. Arrange the specimens of A to form a "ladder", as hereinabove defined.
3. Now try to arrange the specimens of B in a "ladder" of the same overall shape as the ladder tiled by the specimens of A.

Tiling matching ladders in this way is possible only if the Keystones in A and B are located at opposite ends of their respective ladders; this is by no means obvious, and it makes an intriguing puzzle in its own right.

FIGS. 17 through 22 show matched ladders for the six possible pairs of monochrome subsets which can be chosen from the four monochrome subsets for $n=8$.

The monochrome subsets of Coloring Scheme (II) for odd n, as shown in FIG. 6, can be used in a matching puzzle activity which is similar to the aforementioned puzzle for even n, but is somewhat easier. This puzzle activity is as follows:

Define a pseudoladder as a ladder-like strip of specimens which contains precisely the number of rhombuses in a true ladder, but in which the rule that "every non-square rhombus occurs twice: once in a left-leaning orientation and once in a right-leaning orientation" may be violated for one or more pairs of rhombuses in the strip. In other words, at least one shape of rhombus may, although this is not required, appear in the strip twice in a left-leaning orientation, or else twice in a right-leaning orientation.

Matching pseudoladders is a puzzle activity for odd n, using the $(n-1)/2$ monochrome subsets of Coloring Scheme (II), each of which contains $(n-1)/2$ twin specimens. It is as follows:

1. A pseudoladder $P_1$ is formed from the $(n-1)/2$ twin specimens of one of the monochrome subsets.
2. A second pseudoladder $P_2$, which is composed of the $(n-1)/2$ twin specimens of a second monochrome subset, is place snugly alongside $P_1$. It is required that a consecutive chain of rhombuses in $P_2$, which consists of all but one of the $(n-1)/2$ rhombuses in $P_2$, define a shape which is congruent to a similar chain of rhombuses in $P_1$. The unpaired rhombus in $P_1$ will necessarily lie at the end of $P_1$ which is opposite to the site of the unpaired rhombus in $P_2$.

FIGS. 23 through 27 show matched pseudoladders for five of the six possible pairs of monochrome subsets which can be chosen from the four monochrome subsets for $n=9$. For the sixth pair, no matched pseudoladders are possible.

Referring now to the fourth activity, "the tiling of conjugate ovals", an "oval" may be defined as a convex polygon formed by juxtaposition of one or more specimens and having rotational symmetry and having opposite pairs of parallel sides. Every oval has exactly one and only one conjugate. If the specimens are selected from a rombix set for D, and if one oval has $2g_1$ sides, its conjugate oval has $2g_2$ sides, where $g_1+g_2=n$.

Figure 28:
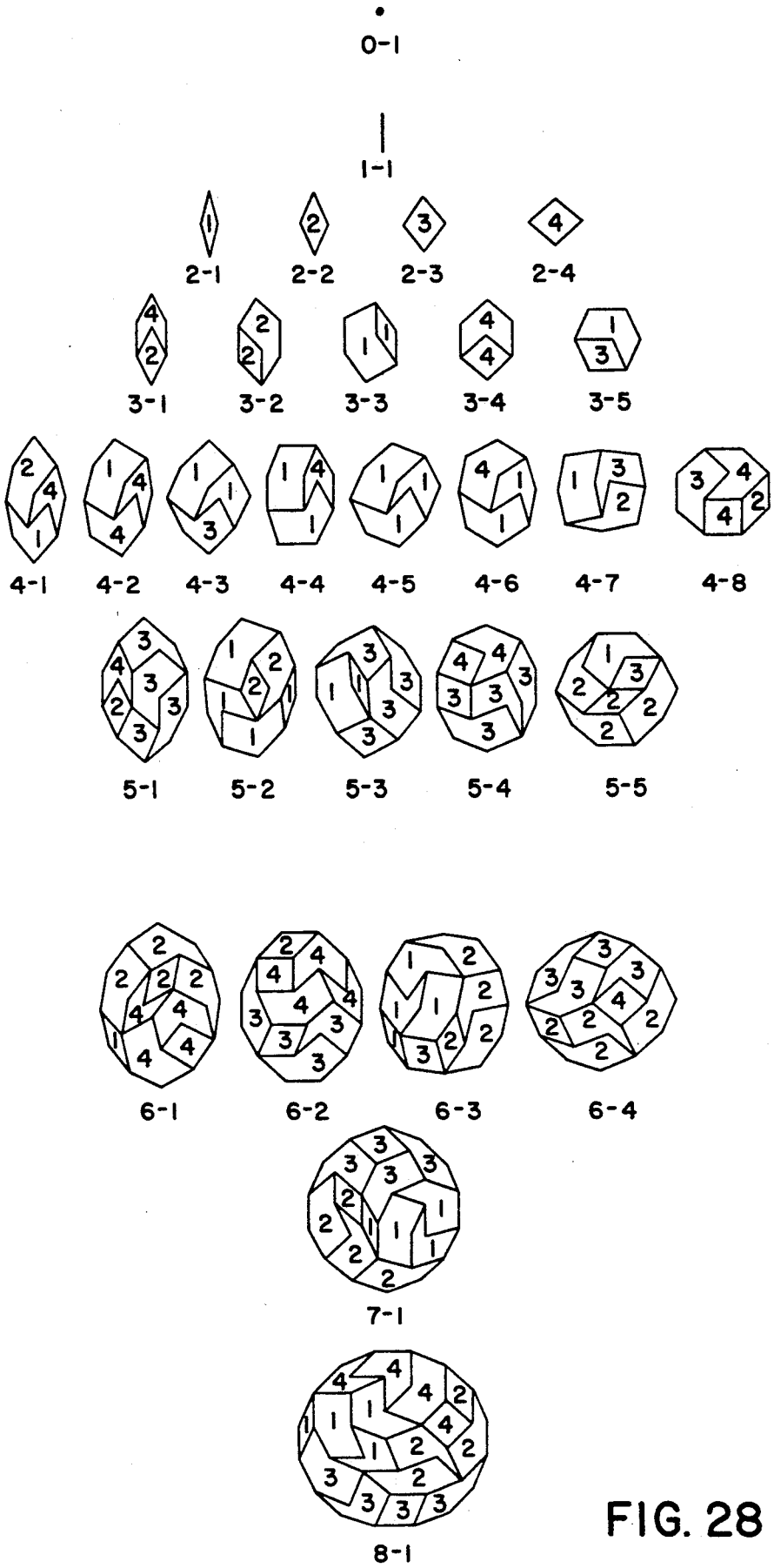
FIG. 28 is a series of plan views, similar to those of the other Figures, showing the ovals for $n=8$.

FIG. 28 illustrates all the ovals for $n=8$. The colors of the specimens are indicated by the numbers 1 to 4, according to the monochrome subset labels of FIG. 3. If the ovals of each "family" (common g-value) are compared with the corresponding ovals in the complementary family (two families, for which $g=g_1$ and $g_2$, respectively, are complementary if $g_1+g_2=n$), it can be verified that the tilings of conjugate ovals for even n follow the rule: "an integer number of monochrome subsets has been combined with the specimens of the smaller oval of each conjugate pair to make the tiling of the larger oval of the pair. This integer number is equal to $g_2-g_1$, where $g_2$ is greater than or equal to $g_1$." It can be verified, in addition, that the ovals of each conjugate pair always have precisely the same symmetry. For even n, the family of ovals for $g=n/2$ is self-conjugate, since $g_2-g_1=0$, band it is therefore not involved in any conjugate oval pair tiling activity.

Figure 29:
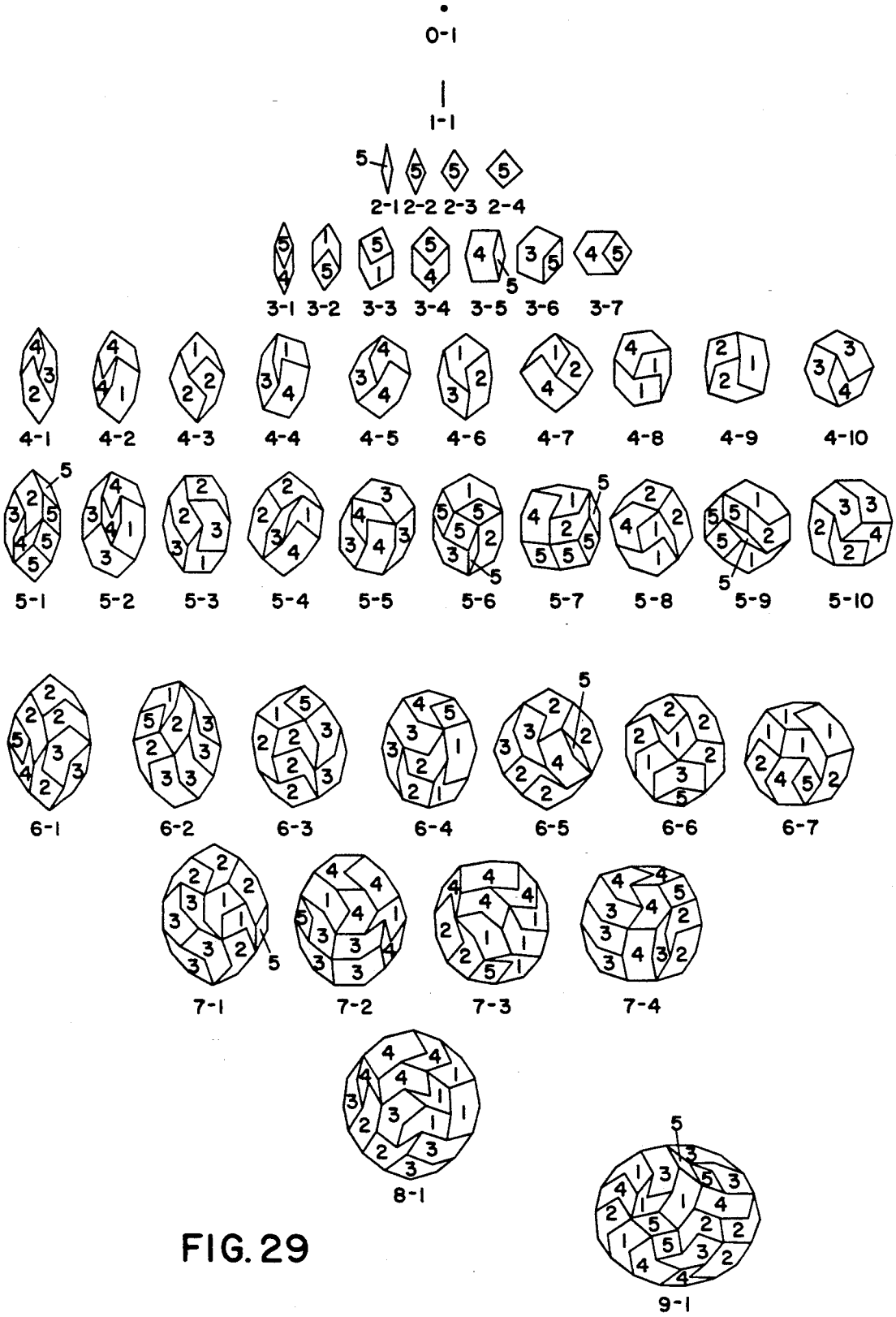
FIG. 29 is a series of plan views, similar to those of the other Figures, showing the ovals for $n=9$.

FIG. 29 illustrates all the ovals for $n=9$. The colors of the specimens are indicated by the numbers 1 to 5, according to the monochrome subset labels of FIG. 6. If the ovals of each "family" (common g-value) are compared with the corresponding ovals in the complementary family (two families, for which $g=g_1$ and $g_2$, respectively, are complementary if $g_1+g_2=n$), it can be verified that the tilings of conjugate ovals for odd n follow the rule: "a half-integer number of monochrome subsets has been combined with the specimens of the smaller oval of each conjugate pair to make the tiling of the larger oval of the pair. This half-integer number is equal to $g_2-g_1$, where $g_2$ is greater than $g_1$." It can be verified, in addition, that the ovals of each conjugate pair always have precisely the same symmetry.

Having thus described the principles of the invention, together with several illustrative embodiments thereof, it is to be understood that, although specific terms are employed, they are used in a generic and descriptive sense, and not for purposes of limitation, the scope of the invention being set forth in the following claims.

I claim:

1. A set of tiles for covering a plane surface bounded by a regular polygon of 2n sides, for forming a repeatable cell, and for other purposes, said regular polygon being dissectible into a set of $(n-1)n/2$ rhombuses, comprising one specimen of each distinct rhombus in said set and one specimen of each distinct shape formed by combining two of the remaining rhombuses in said set in such a manner that no two edges at any vertex are collinear, each said specimen formed by thus combining two rhombuses having an outer notch in its periphery and being identifiable by two integers i and j which are the indices of the convex interior face angles flanking said notch, wherein i is not less than j, said tiles covering said plane surface in the following configuration of vertical columns of specimens, wherein all said notches in the longest vertical column face in the same direction and all said notches in the other vertical columns face said longest vertical column, and the integers within each bracket identify the particular specimen as well as its orientation:

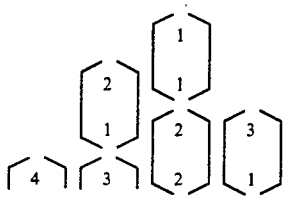

etc., said configuration setting forth a series of rows of integers as shown in which each succeeding row reverses the order of the integers in the next preceding row and adds the next higher integer after the highest integer of said preceding row until the last row, in which the highest integer is $n-1$ and in which completion of the row is achieved by brackets having a single integer rather than a pair of integers so as to designate the specimens each of which is a rhombus, the index of any angle of A degrees being defined as equal to $An/180$, or in the mirror image of said configuration.

2. A set of tiles in accordance with claim 1, wherein n is even and each vertical column of specimens is identified by a characteristic color or other characterizing mark in such a manner that the longest vertical column has one mark and the sequence of marks of successive vertical columns to the left from said longest vertical column is the reverse of the sequence of marks of successive vertical columns to the right from said longest vertical column.

3. A set of tiles in accordance with claim 1, wherein n is even and the longest vertical column of specimens and the horizontal rows of specimens on either side of said column are identified by a characteristic color or other characterizing mark in such a manner that the longest vertical column has one mark and the specimens the notches whereof face towards the notches of said longest vertical column form a first configuration of rows each having a characteristic color or other characterizing mark which differs from that of the longest vertical column and from that of all other rows in said first configuration of rows, the sequence of marks of successive horizontal rows from the bottom row to the top row being identifiable by a sequence of integers 1,2,3 . . . k, where k is the number of said horizontal rows, the remaining specimens forming a second configuration of rows each having a characteristic color or other characterizing mark which differs from that of the longest vertical column and from that of all other horizontal rows in said second configuration of rows except for the bottom row thereof, the sequence of marks of successive horizontal rows from the top row to the row immediately above the bottom row being identifiable by the sequence of integers 2,3, . . . k, where each integer has the aforementioned significance, and wherein the sequence of marks of successive specimens in said bottom row of said second configuration from said longest vertical column is identifiable by the sequence of integers k, (k−1), . . . 1, where each integer has the aforementioned significance.

4. A set of tiles in accordance with claim 1, wherein n is odd and each vertical column of specimens is identified by a characteristic color or other characterizing mark in such a manner that the sequence of marks of successive vertical columns from the left to the left-hand vertical column of the pair of longest vertical columns is the reverse of the sequence of marks of successive vertical columns from the right to the right-hand vertical column of said pair of longest vertical columns.

5. A set of tiles in accordance with claim 1, wherein n is odd and each vertical column of specimens at that side of the longest vertical column which is remote from the notches in the specimens comprising said longest vertical column is identified by a characteristic color or other characterizing mark in such a manner that the sequence of marks of successive vertical columns from (but not including) said longest vertical column to said one side is the same as the sequence of marks of successive horizontal rows of specimens at the other side of said longest vertical column from the top to (but not including) the bottom row, said longest vertical column and said bottom row each being identified by a separate mark.

6. A monochrome sub-set consisting of any group of all specimens of the same mark according to claim 2.

7. A monochrome sub-set consisting of any group of all specimens of the same mark according to claim 3.

8. A monochrome sub-set consisting of any group of all specimens of the same mark according to claim 4.

9. A monochrome sub-set consisting of any group of all specimens of the same mark according to claim 5.

10. A method of tiling using the set of tiles described in claim 1 wherein n is even, comprising (a) arranging one or more of said tiles so as to form a first convex polygon having rotational symmetry and opposite pairs of parallel sides, and (b) combining the tiles of said first convex polygon with one or more of the monochrome subsets described in claims 6 or 7 so as to form a second convex polygon conjugate to said first convex polygon.

11. A method of tiling using the set of tiles described in claim 1 wherein n is odd, comprising (a) arranging one or more of said tiles so as to form a first convex polygon having rotational symmetry and opposite pairs of parallel sides, and (b) combining the tiles of said first convex polygon with a half-integral number of monochrome subsets selected from those monochrome subsets described in claims 8 or 9 which are composed of single-rhombus specimens or divisible into two halves such that each specimen of one half is composed of rhombuses identical to those of a specimen of the other half but differing in shape from said specimen, so as to form a second convex polygon conjugate to said first convex polygon.

12. An arrangement, in a convex polygon having rotational symmetry and opposite pairs of parallel sides, of tiles selected from the set of tiles described in claim 1 wherein n is even, comprising in combination (a) the tiles used to form the smaller convex polygon of a conjugate pair of convex polygons having rotational symmetry and opposite pairs of parallel sides and (b) one or more of the monochrome subsets described in claim 9 which are composed of single-rhombus specimens or divisible into two halves such that (collectively) the specimens in each half contain exactly the same total inventory of rhombuses, namely, one specimen of each of the $(n-1)/2$ different shapes of rhombuses, so as to form a second convex polygon conjugate to said first convex polygon.

13. An arrangement, in a convex polygon having rotational symmetry and opposite pairs of parallel sides, of tiles selected from the set of tiles described in claim 1 wherein n is odd, comprising in combination (a) the tiles used to form the smaller convex polygon of a conjugate pair of convex polygons having rotational symmetry and opposite pairs of parallel sides and (b) a half-integral number of monochrome subsets selected from those monochrome subsets described in claim 9 which are composed of single-rhombus specimens or divisible into two halves such that (collectively) the specimens in each half contain exactly the same total inventory of rhombuses, namely, one specimen of each of the $(n-1)/2$ different shapes of rhombuses, so as to form a second convex polygon conjugate to said first convex polygon.

14. A game method associated with one or two sets of tiles, wherein each of said sets is a set of tiles for covering a plane surface bounded by a regular polygon of 2n sides, for forming a repeatable cell, and for other purposes, said regular polygon being dissectible into a set of $(n-1)n/2$ rhombuses, comprising one specimen of each distinct rhombus in said set and one specimen of each distinct shape formed by combining two of the remaining rhombuses in said set in such a manner that no two edges at any vertex are collinear, the rules of the game method comprising the following steps: one player uses specimens from said sets to tile the smaller polygon of a conjugate pair of convex polygons having rotational symmetry and opposite pairs of parallel sides, and each other player in turn makes use of the specimens in said sets of tiles, including the specimens in said tiled polygon, to construct the larger polygon of said conjugate pair, the first such player to succeed in such construction being the provisional winner.

15. A game method in accordance with claim 14, wherein the player to construct the larger polygon in any one or more of the following specified ways is the ultimate winner:

(a) in the specimens added to the smaller polygon in order to construct the larger polygon, said added specimens being designated the "oval increment", there must be no substituting of specimens of colors different from those selected to make up the oval increment (i.e. the oval increment should contain the smallest possible number of colors), (b) if possible, the smaller oval should be imbedded intact inside the larger oval (i.e., its specimens should not be scattered in the tiling of the larger oval, (c) the specimens in the oval increment should be sequestered in the smallest possible number of simply-connected monochrome regions, and (d) in the case of odd n, whenever possible, the keystone subset should not be used to compose the half-integer monochrome subset (instead, whenever possible, the required half-subset should be made by using half of a divisible monochrome (twin) subset.

* * * * *